US005085336A

United States Patent [19]

Lynd

[11] Patent Number: 5,085,336

[45] Date of Patent: Feb. 4, 1992

[54] CAP ASSEMBLY

[75] Inventor: L. Grant Lynd, Canal Winchester, Ohio

[73] Assignee: Lynd Properties, Inc., Columbus, Ohio

[21] Appl. No.: 667,127

[22] Filed: Mar. 11, 1991

[51] Int. Cl.[5] ..... A47G 19/22

[52] U.S. Cl. ..... 220/708; 220/254; 222/536

[58] Field of Search ..... 220/90.2, 90.4, 90.6, 220/85 SP, 254; 222/533, 534, 536; 215/235

[56] References Cited

U.S. PATENT DOCUMENTS

| | | | |
|---|---|---|---|
| 2,573,378 | 10/1951 | Zurlinden | 215/235 |
| 3,372,832 | 3/1968 | Yeater et al. | 220/254 |
| 3,739,938 | 6/1973 | Paz | 220/90.4 |
| 3,907,179 | 9/1975 | Pehr et al. | 222/536 X |
| 4,133,446 | 1/1979 | Albert | 220/90.4 |
| 4,209,114 | 6/1980 | Wilson et al. | 222/536 |
| 4,291,814 | 9/1981 | Conn | 220/90.4 |
| 4,407,425 | 10/1983 | Combs | 220/85 SP X |
| 4,589,569 | 5/1986 | Clements | 220/90.4 X |
| 4,693,399 | 9/1987 | Hickman et al. | 220/254 X |
| 4,892,234 | 1/1990 | Bennett | 222/534 X |
| 4,986,437 | 1/1991 | Farmer | 220/90.4 X |

FOREIGN PATENT DOCUMENTS

| | | | |
|---|---|---|---|
| 431182 | 2/1948 | Italy | 220/254 |

*Primary Examiner*—Stephen Marcus
*Assistant Examiner*—Paul A. Schwarz
*Attorney, Agent, or Firm*—Biebel & French

[57] ABSTRACT

A cap assembly is provided having a top wall with a first aperture and a second aperture formed therein, a wall member which extends upwardly from at least a portion of the top wall, and first and second closing members both of which are selectively adjustable to a first and a second position. The first closing member comprises a base portion having a channel formed therethrough. When the first closing member is adjusted to its first position it forms a seal across the first aperture. Meanwhile, when the base portion is adjusted to its second position, the channel cooperates with the first aperture to form a passage through the cap. The second closing member also comprises a first portion and a second portion. When the second portion of the second closing member is adjusted to its first position, it forms a seal across the second aperture.

21 Claims, 3 Drawing Sheets

CAP ASSEMBLY

BACKGROUND OF THE INVENTION

The present invention relates generally to caps designed specifically for utilization in consuming of liquids from a container, and more particularly, to such a device which permits the user to obtain liquid either by sipping as from a cup, or by passage of the liquid through a straw-like member.

Over the past several years, plastic squeeze bottle and cap assemblies have dramatically increased in popularity. For sanitation purposes and convenience of drinking, the bottles are typically of a one quart size and are provided with a drinking tube that extends exteriorly in the bottle. The drinking tube is generally provided with an end cap at the exterior end for purposes of sanitation and to prevent entry of debris during such time as the bottle is merely resting on the ground or on any other type of supporting surface. The bottle itself is generally fabricated from a plastic material with the wall thickness being such that, when desired, the bottle may be partially collapsed in attempting to facilitate the drinking operation.

In actual use, the drinking bottles associated with the prior art may be utilized in either of two ways. The first type of use involves the user placing the end of the drinking tube in his mouth and then sucking on the tube to withdraw liquid from the interior of the bottle. This type of use requires either that there be a means to permit inflow of air to the bottle, or that the user must intermittently release the tube so that air may then flow into the bottle. This is essential, as a vacuum is otherwise generated, such that withdrawal of the liquid is substantially prevented after a certain amount of liquid has been withdrawn. Typically the venting means is in the form of a small hole in the top wall of the cap or in the form of a valve means.

The second major type of use of a bottle of this type is through the individual squeezing the bottle to forcibly eject the liquid through the drinking tube. This technique of utilization of the drinking bottle requires that the bottle form a liquid-type seal with respect to the drinking tube and otherwise be closed, so that the collapsing of the flexible wall of the bottle will result in the compression of the air in the bottle and thereby effect the forcible ejection of liquid through the tube.

A dissimilar type of drinking device associated with the prior art involves a cap which covers the top of a cup-like device, with the cap being provided with a slot having a hinged flap attached to the top wall of the cap, with this flap serving as a cover for the slotted opening. Tipping of the cup into a position enabling the user to sip liquid from the cup can result in the flap being displaced by the liquid, thereby enabling the user to drink from the capped cup.

These two types of caps have heretofore been incompatible with each other, such that an individual must own two separate drinking containers and two separate caps, one set of each type. Additionally, prior art caps with the drinking tube do not allow the user to drink from the device in the same leisurely manner as is associated with the slotted cap.

It is thus apparent that the need exists for improved cap assembly which provides for greater flexibility with respect to drinking modes.

SUMMARY OF THE INVENTION

The problems associated with the prior art cap assemblies are overcome in accordance with the present invention by forming a cap assembly having a top wall with a first aperture and a second aperture formed therein, and with first and second closing members both selectively adjustable to first and a second positions. The first closing member includes a base portion having a channel formed therethrough. When the first closing member is adjusted to the first position, the base portion forms a seal across the first aperture. Similarly, when the first closing member is adjusted to the second position, the base portion channel cooperates with the first aperture to form a passage through the cap for the drinking of a liquid.

The second closing member includes a first portion and a second portion. When the second closing member is adjusted to its first position, the second portion of the second closing member forms a seal across the second aperture. When the second closing member is adjusted to its second position, the second portion opens the second aperture to form a passage through the cap for the drinking of a liquid.

In accordance with this invention, the first and second closing members are secured to the cap, and more preferably are pivotally secured to the cap. In the preferred embodiment of the invention the first aperture is formed having a circular configuration, while the second aperture is formed with at least a partially curve sidewall, to in effect resemble the slot associated with caps of the prior art.

In the preferred embodiment of the invention, the first and second closing members are retained within respective first and second recessed portions of the top wall of the cap. Extending upwardly from at least a portion of the top wall is a wall member. Additionally in the preferred embodiment of the invention an annular ring extends outwardly from the wall member and has a flange depending downwardly therefrom. Preferably the flange has a screw-thread.

The wall member of the cap of this invention features an upper edge with the top wall being inclined relative to this upper edge. Consequently, the height of the wall member adjacent the first closing member is significantly less than the height of that portion of the wall member in the vicinity of the second closing member.

It is the primary object of the present invention to provide a cap assembly which can be utilized either in a mode associated with caps of the prior art of the type having a drinking tube, as well as in a mode associated with caps of the type associated in the prior art with cups.

Further, it is an objective of the present invention to provide a cap which creates an interesting visual effect.

Still further it is an objective of the present invention to provide a cap assembly which, when closed, prevents the escape of heat through the cap when this particular cap assembly is utilized in conjunction with either a squeeze bottle or cup containing a liquid.

Other objects and advantages of this invention will be apparent from the following description, the accompanying drawings, and the appended claims.

DETAILED DESCRIPTION OF THE INVENTION

Figure 1:
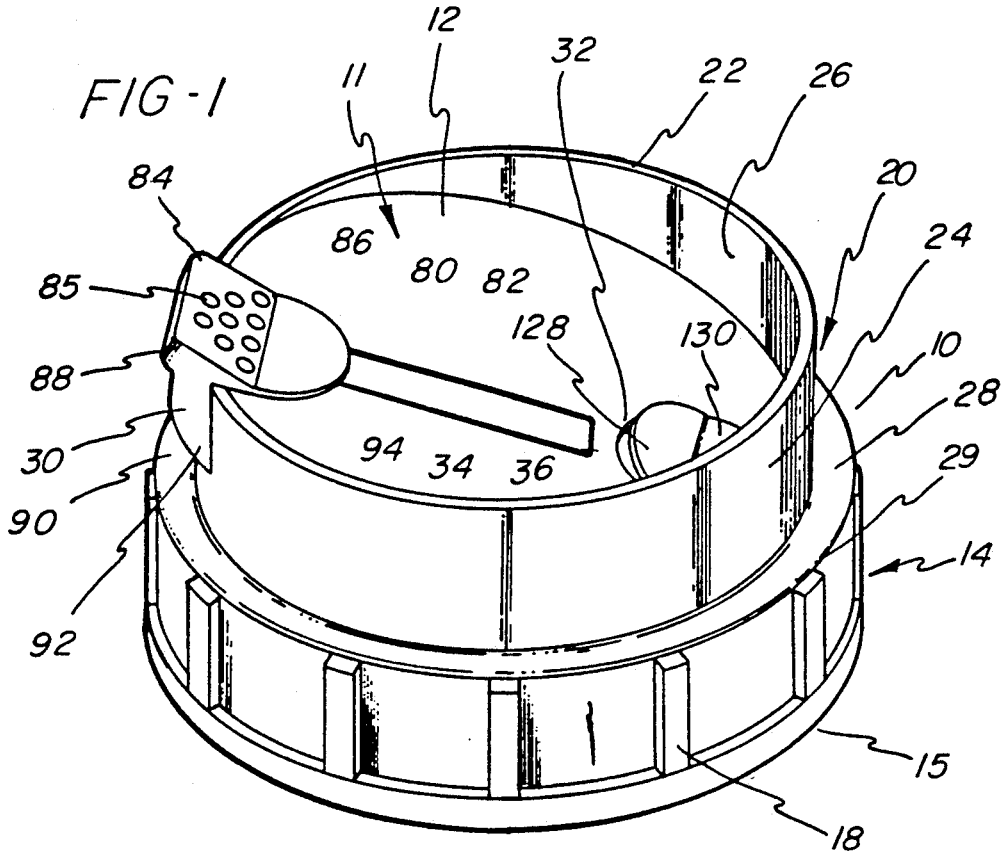
FIG. 1 is a perspective view of a cap assembly embodying this invention.
Figure 4:
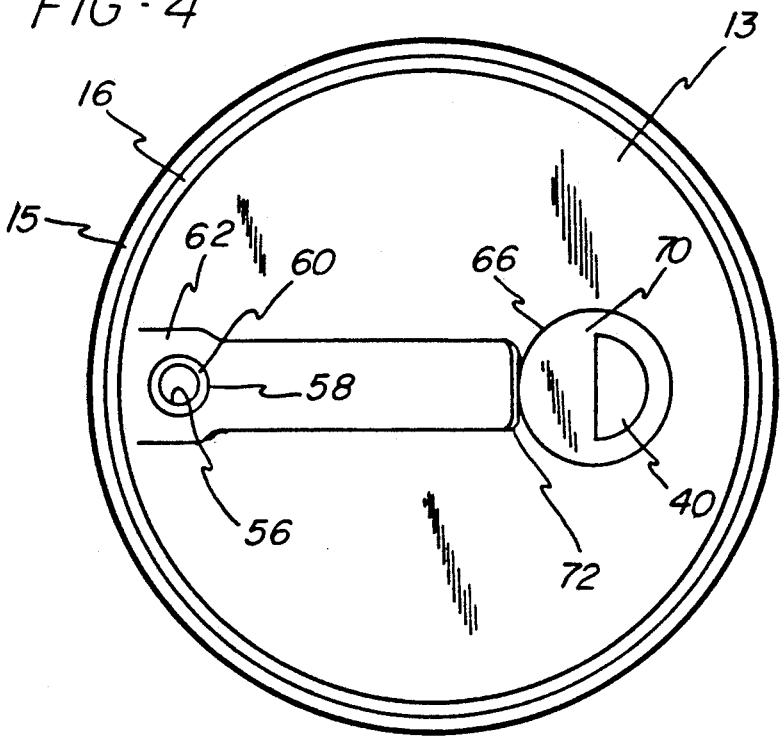
FIG. 4 is a bottom plan view of the cap assembly as shown in FIG. 3.

Having reference to the drawings, attention is directed first to FIG. 1 which discloses a cap assembly made in accordance with the present invention and designated generally by the numeral 10. Preferably the cap assembly of the invention is advantageously formed by a blow molding process form a suitable type of plastic material. The cap of this invention includes a top wall 11, which is for the most part planar. This top wall has an upper surface 12 and a lower surface 13 as can better be seen in FIG. 4. Preferably the cap of this invention includes a flange 14 which is interconnected with the top wall 11, with flange 14 adapted to fit over and mechanically inter-engage with a container for holding liquid. As can be seen in FIGS. 1 and 4, the flange 14 includes a bottom edge 15. As can also be seen in FIGS. 5 and 6, the interior surface of flange 14 is provided with an integrally molded screw-thread 16 designed to cooperatively interfit with a mating screw thread formed on the exterior of the container for holding a liquid. Although the cap as shown discloses a screw-thread type of interconnection, it will be understood that other means of interconnection may be employed such as the twist-lock type of interconnection, or a friction fit method.

A number of short vertically extending ribs 18 are formed in uniformly angularly spaced relationship around the exterior of the flange 14. These ribs are intended to provide a better means of gripping the cap to either remove or apply the cap. Other types of frictional surface treatment or configurations of ribs may be utilized for this purpose.

Figure 5:
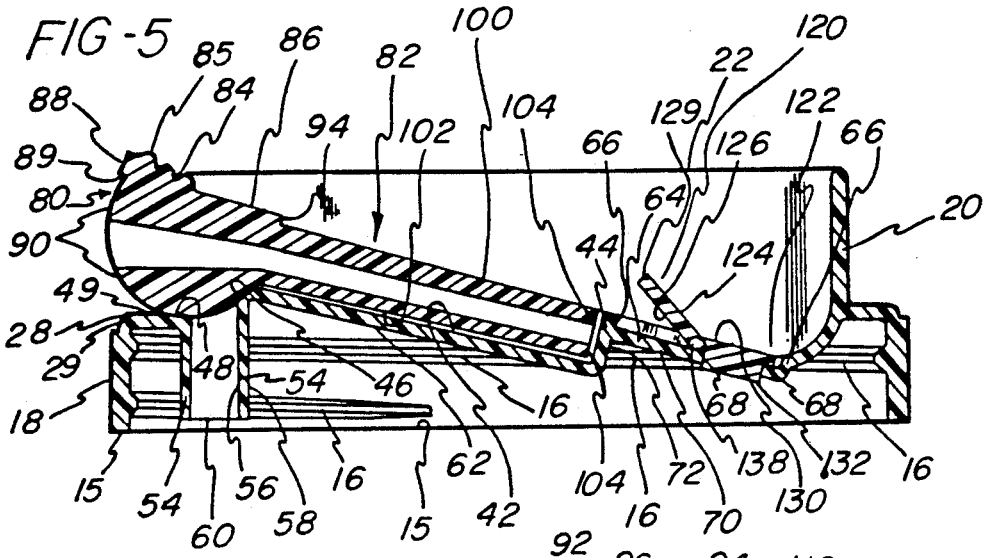
FIG. 5 is a vertical sectional view on an enlarged scale taken along line 5—5 of FIG. 2.
Figure 6:
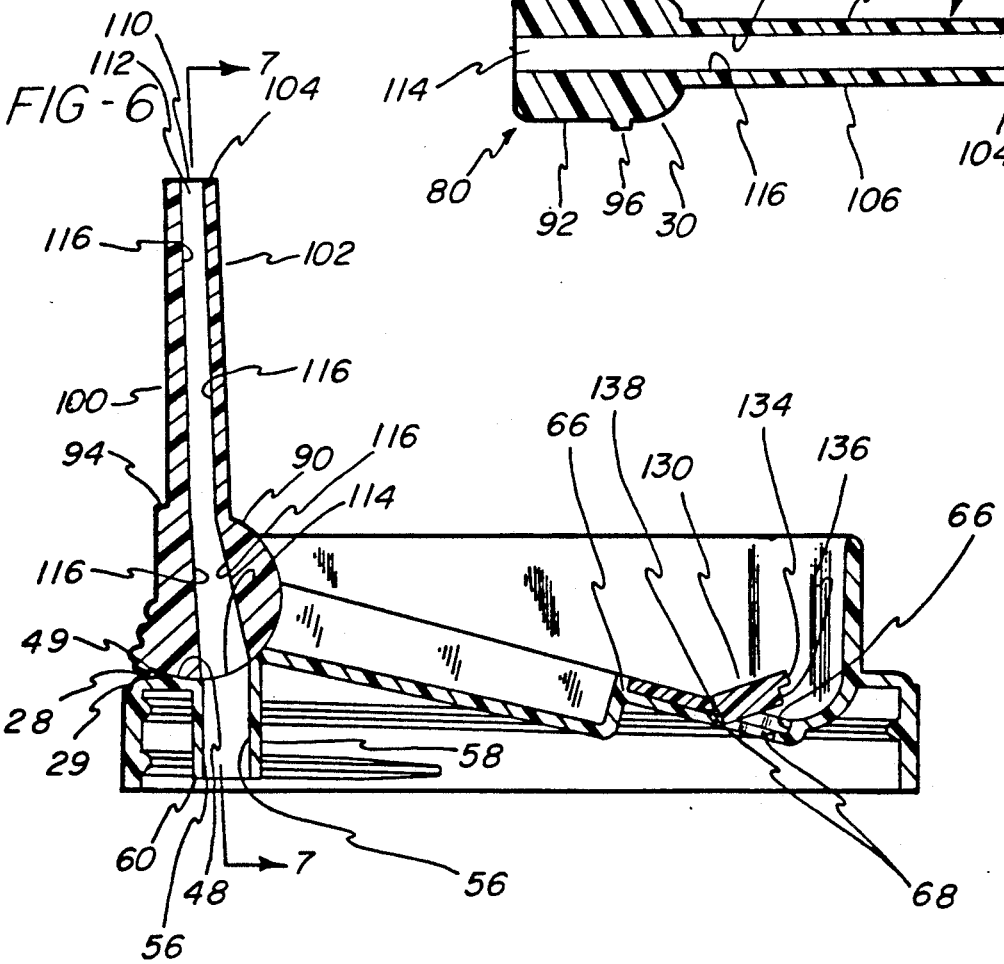
FIG. 6 is a vertical sectional view similar to FIG. 5, but showing the cap assembly in an operative position.

Extending upwardly from at least a portion of the top wall 11 is a wall member 20. With respect to the upper surface 12, the wall member may be interconnected thereto at a relatively sharp angle or by means of a gently curving portion as shown in FIGS. 5 and 6.

Figure 3:
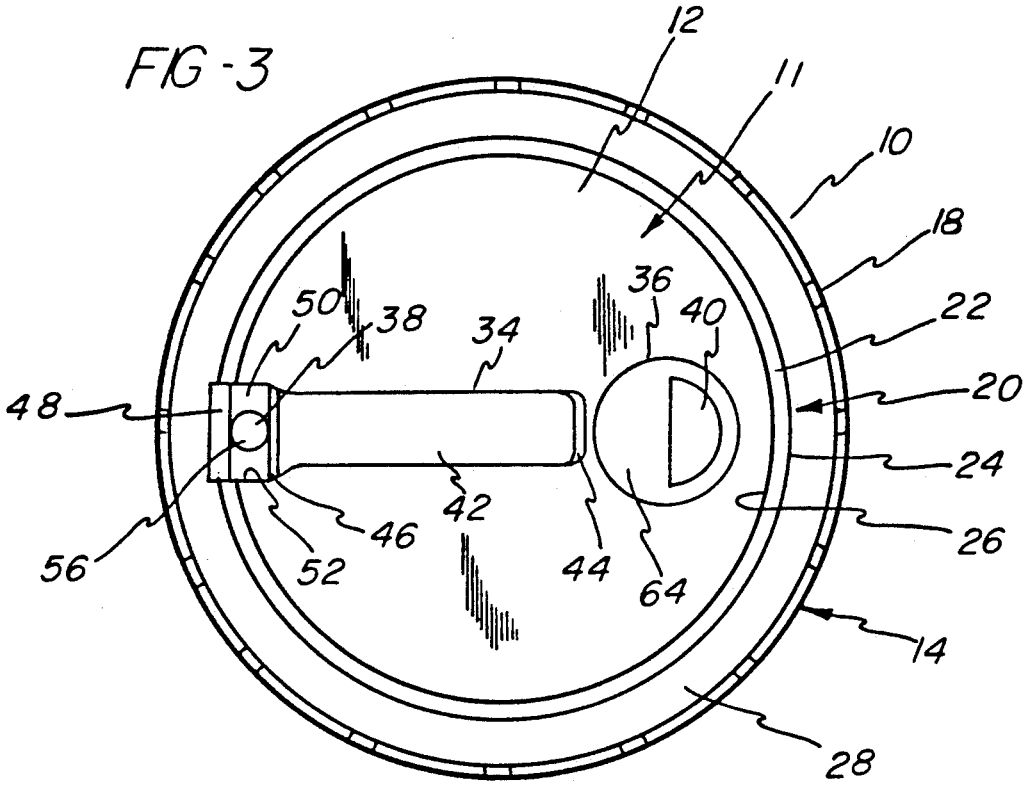
FIG. 3 is a top plan view similar to FIG. 2 but showing the cap assembly of this invention with the first and second closing members removed.

Wall member 20 features an upper edge 22 which is preferably formed approximately perpendicular to the wall member outer surface 24 and the wall member inner surface 26 as can be appreciated from a comparison of FIGS. 1 and 3. Portions of wall member 20 can be seen in FIG. 1 as also extending downwardly from at least a portion of the top wall 11. Extending outwardly from wall member 20 is an annular ring 28 having a rounded peripheral shoulder 29, with this annular ring being shown as having flange 14 depending downwardly therefrom.

The cap assembly made in accordance with this invention is shown in FIGS. 1, 2, 5 and 6 as comprising a first closing member 30 and a second closing member 32. The first and second closing members are secured to the cap, and in the preferred embodiment of the invention are pivotally secured to the cap adjacent the top wall 11.

In the preferred embodiment of the invention, the first closing member 30 is secured within a trough-like first recessed portion 34. Similarly, in the preferred embodiment of the invention, the second closing member 32 is secured within an approximately circular second recessed portion 36, although the configuration of the second recessed portion could be other than approximately circular.

As can be seen by a comparison of FIGS. 3, 5 and 6, the first recessed portion 34 features an aperture 38 which is disclosed as being of a circular configuration. Similarly, the second recessed portion 36 is shown as having an aperture 40 with at least a portion of the second aperture being curved.

In comparing FIGS. 3 and 5, the first recessed portion 34 is shown as having an upper surface 42 and an end wall 44 extending upwardly from the upper surface 42 of the trough at the lower most end of the trough. The first recessed portion 34 also comprises a first curved portion 46, as can be seen in FIGS. 3, 5 and 6, with this first curved portion being located adjacent the upper surface 42 at the opposite end of the trough from end wall 44.

A second curved portion 48 is shown on the opposite side of aperture 38 from the first curved portion 46. In the preferred embodiment of the invention an inclined surface portion 49 is located between the second curved portion 48 and the annular ring 2. Although the annular ring 28, the bottom edge 15, and the upper edge 22 are preferably all approximately parallel to each other, the first curved portion 46 and second curved portion 48 are formed so as to cooperatively friction-fit wit the curved portion of the first closing member 30. In fact, a first aperture curved portion 50 shown in FIG. 3 connects the first curved portion 46 and second curved portion 48, and has associated with it the same curvature as is associated with the immediately adjacent contacting surface portion of the first closing member 30.

Figure 2:
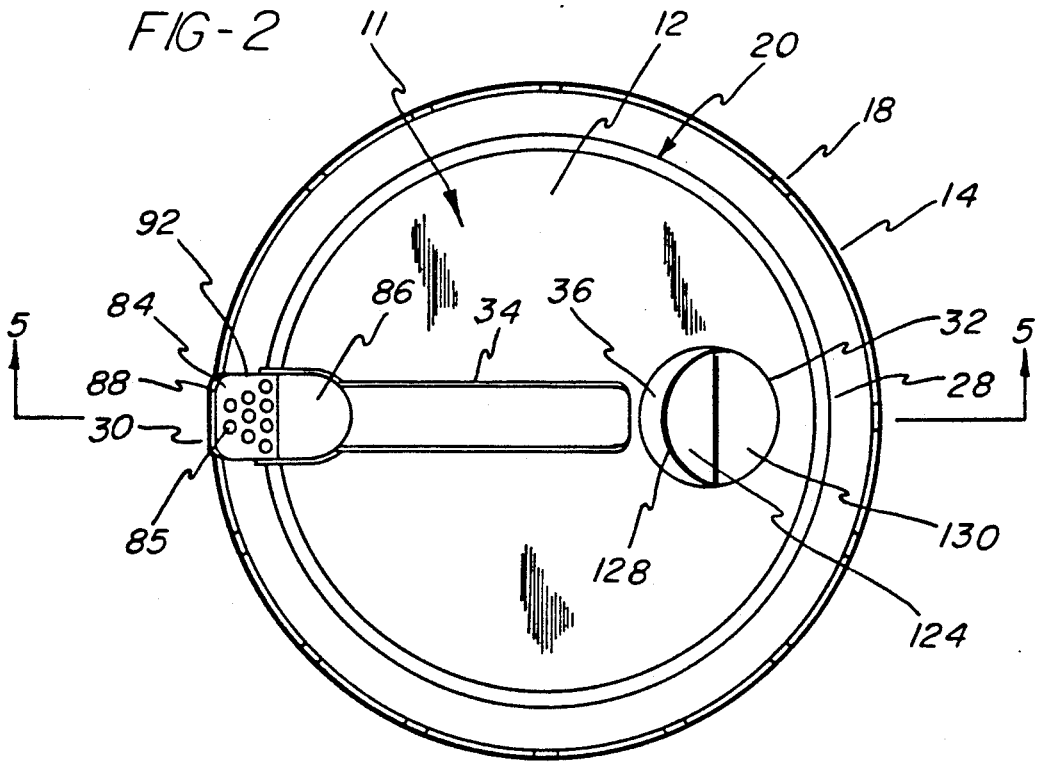
FIG. 2 is a top plan view of the cap assembly of this invention.

As can be seen in FIGS. 1, 2 and 3, the first recessed portion 34 also comprises sidewalls 52. Similarly, the first aperture 38 features a sidewall 54 as can be seen in FIG. 5, with this sidewall 54 having an inner surface 56, an outer surface 58 and a bottom edge 60, as can be appreciated by a comparison of FIGS. 4, 5 and 6. The first recessed portion 34 is also disclosed as having a lower surface portion 62 as can best be seen in FIG. 5.

The second recessed portion 36 is disclosed in FIGS. 3 and 5 as having an upper surface 64 with an approximately circular recessed sidewall 66. Similarly, the second aperture 40 comprises a sidewall 68 as can best be seen in FIGS. 5 and 6. Furthermore, the second recessed portion 36 includes a lower surface 70. FIG. 5 discloses a lower surface connecting portion 72 extending between the lower surface portion 62 of the first recessed portion 34 and the lower surface 70 of second recessed portion 36. This lower surface connecting portion is also shown in FIG. 4.

Turning now to the specific configurations of the first and second closing members, a comparison of FIGS. 1, 2, 5, 6 and 7 reveals that the first closing member 34 comprising a base portion 80 and an elongated portion 82. The base portion 80 includes a first planar portion 84 having raised dome-like portions 85, and a second planar portion 86. An edge portion 88 is shown as being adjacent the first planar portion 84. This edge portion 88 has a lower surface 89 from which depends a curved portion 90. This curved portion 90 of the end wall of the base portion 80 extends beneath the base portion and forms a bottom wall thereof as can be appreciated from FIG. 5.

Figure 7:
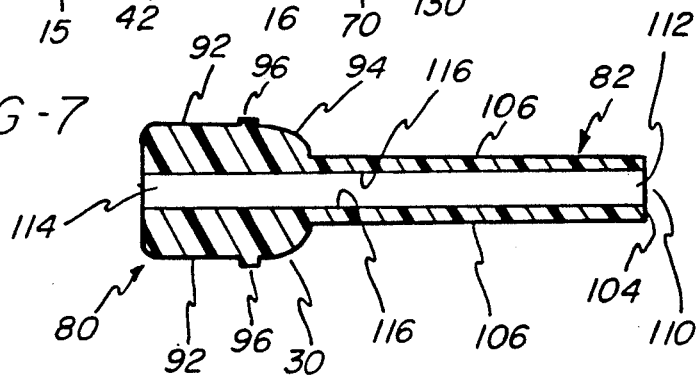
FIG. 7 is a vertical sectional view taken along line 7—7 of FIG. 6.

The base portion 80 also includes sidewalls 92, preferably formed parallel to one another as can be seen in FIGS. 2 and 7. The base portion also includes a curved edge portion 94 as can best be seen in FIGS. 1 and 7, with this curved edge portion 94 also being intermediate the elongated portion 82 and the second planar portion 86 of the base portion.

As can be seen in FIGS. 1, 2, 5 nd 6, the first planar portion is at an angle with respect to the second planar portion 86. Furthermore as can be seen in FIG. 7, pins 96 are the preferred means of attachment for the first closing member 30 to the first recessed portion 34 with the pins 90 being rotatable within apertures (not shown) in the sidewall 52 in the area of the first recessed portion which is adjacent to the base portion 80, with that portion of the sidewall 52 preferably being slightly curved. Thus the first closing member is secured adjacent the first recessed portion.

Turning now to the elongated portion 82 of the first closing member 30, a comparison of FIGS. 5, 6 and 7 disclose that the elongated portion 82 has a first surface 100 which corresponds to the upper surface of the elongated portion shown in FIG. 5, and a second surface 102 which corresponds to the lower surface of the elongated portion 82 shown in FIG. 5. The elongated portion is shown as having a tip 104 at the terminus of the elongated portion, with this tip being positionable adjacent end wall 44.

As can be seen in FIG. 7, the tip 104 has a pair of parallel sidewalls 106. Formed within the first closing member 30 is a channel 110 with this channel having a tip end 112 and a base end 114 as well as an inner surface 116. The cross section of the channel 110 at the tip 104 of the elongated portion 82 resembles a rectangle with the distance between first surface 100 and second surface 102 being less than the distance between opposite sidewalls 106. As the channel exits the elongated portion 82 and enters the base portion 80 of the first closing member, the cross sectional area of the channel preferably begins to increase such that the base end 114 of the channel is equivalent in cross section to the first aperture 38. This results in the forming of a fluid-tight seal adjacent the passage formed by the channel and the first aperture, when the first recessed member is in it operative position. Consequently, it would be appreciated that the channel 110 changes its cross section from roughly that of a rectangle to that of a circle. Preferably, that portion of the channel in the elongated portion has its sidewall contiguous to that portion of the channel in the base portion.

Turning now to the second closing member 32, a comparison of FIGS. 1, 2, 5 and 6 discloses that it also comprises a first portion 120 and a second portion 122, with the two portions preferably angled with respect to one another, and more preferably angled at an angle of greater than 90°. The first portion 120 has a upper surface 124, a lower surface 126, and a sidewall 128 extending about the periphery of the first portion 120.

Similarly, second portion 122 has an upper surface 130 and a lower surface 132. An upper sidewall 134 is shown as being adjacent the upper surface 130 of second portion 122. Preferably the shape of this upper sidewall 134 conforms to that portion of the circular recessed sidewall 66 to which it is adjacent. Additionally, the second portion 122 features a lower sidewall 136 which conforms to the second aperture sidewall 68. Preferably the second closing member 32 is secured to the cap, and more specifically within the second recessed portion 36 by means of pin 138 located approximately at the juncture of first portion 120 and second portion 122. These pins rotate in apertures (not shown) in the sidewall of the second recessed portion.

As can be appreciated from a comparison of FIGS. 1, 2, and 5, the first closing member has associated therewith a first position whereby the base portion 80 forms a fluid-tight seal across first aperture 38. As can be seen in a comparison of FIG. 5 with FIG. 6, the first closing member is selectively adjustable to a second position whereby channel 110 cooperates with the first aperture to form a passage through the cap for the drinking of a liquid. Preferably the walls of the channel are contiguous with respect to the sidewall of the first aperture. In this embodiment, with the second closing member being closed as shown in FIG. 5, air pressure within the container to which this cap assembly is secured serves to forcibly eject the liquid through the channel 110.

Additionally, positioning of the first closing member 30 into the second position as shown in FIG. 6 permits the user to tilt the container, preferably a squeeze bottle, so as to permit the gravity flow of liquid through the channel 110 from the base end 114 to the tip end 112. Consumption of liquid in this manner is not dependent upon squeezing of the container to which the cap assembly is secured. However, the lack of venting will eventually necessitate the intermittent passage of air through the channel 110 thereby alleviating the vacuum problem.

Just at the first closing member of this invention is selectively adjustable between a first and a second position, similarly the second closing member is selectively adjustable to a first and a second position. The first position is shown in FIG. 5, and the second position is shown in FIG. 6. In the first position, the second portion 122 of the second closing member 32 results in the forming of a fluid-tight seal across second aperture 40 with the lower sidewall 136 being disposed just inwardly of the second aperture sidewall 68. Similarly, it will be appreciated that the lower surface 132 is approximately coterminous with the lower surface 70 of the second recessed portion 36. It will also be appreciated that the upper surface 130 of second portion 122 is essentially coterminous with the upper surface 12 of top wall 11 when the second closing member is in its first position.

Just as the application of pressure on the first planar portion 84 results in the pivoting of the first closing member 30 from the position shown in FIG. 5 to the position shown in FIG. 6, the application of pressure to the upper surface 124 of first portion 120 of the second closing member results in the pivoting of that closing member about pin 138 to the position shown in FIG. 6. In that position, the upper surface 124 is then coterminous with the upper surface 12 of top wall 11 and the second portion 122 is no longer engaged with respect to the second aperture 40.

With the first and second closing members in the positions shown in FIG. 6, any problems with a vacuum are eliminated, since the second closing member effectively acts as a venting means. Consequently, the first closing member can be utilized much as a straw to permit the sucking of liquid through the passage formed by the cooperation of the first aperture 38 and the channel 110. Proper orientation of the channel 110 with respect to the first aperture 38 is made possible by the mechanical engagement of the edge portion 88 with the annular ring 28. The mechanical engagement between the edge portion 88 and the annular ring 28 prevents the rotation of the first closing member beyond the desired position shown in FIG. 6.

With first closing member 34 in the first position as shown in FIG. 5, and the second closing member in the second position as shown in FIG. 6, the cap assembly of this invention also permits the user to consume a liquid through the opening associated with the second aperture 40 similar to that associated with the caps of the prior art having only a single slotted opening.

It will be readily apparent from the foregoing detailed description of the illustrative embodiments of the cap assembly of this invention that a novel and particularly useful device is provided. The structure provides the unique ability for the user to utilize the cap assembly to obtain liquid by a variety of modes of operation.

Additionally, the configurations of the cooperating two closing members and their adjustable positions permit a total fluid-tight seal to be formed by the cap of this invention. This sealing mechanism results in a cap which eliminates much of the heat escape associated with caps of the prior art.

Finally, the cap of this invention, with its unique slanted top wall and innovative straw-like member is visually striking and aesthetically pleasing. Additionally, the presence of the relatively large first and second closing members, in comparison to prior art caps, is a departure from cap design wherein only the one means for intended liquid egress, the drinking tube or slotted opening, was relatively prominent in size.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A cap assembly for drinking of liquids comprising a top wall, said top wall having a first aperture and a second aperture formed therein, a wall member extending upwardly from at least a portion of said top wall, said wall member having an upper edge, said top wall being inclined relative to said upper edge, and first and second aperture closing members, said first and second aperture closing members both independently, and selectively adjustable to a first aperture and a second position, said first aperture closing member comprising a base portion, said base portion having a channel formed therethrough, said base portion when said first aperture closing member is adjusted to said first position forming a seal across said first aperture, said base portion when said first aperture closing member is adjusted to said second position having said channel cooperate with said first aperture to form a passage through said cap for the drinking of a liquid, said second aperture also forming a passage through said cap for the drinking of a liquid.

2. The cap assembly according to claim 1 wherein said first aperture closing member is secured to said cap.

3. The cap assembly according to claim 1 wherein said first aperture closing member is pivotably secured to said cap.

4. The cap assembly according to claim 1 wherein said top wall has formed therein a first recessed portion.

5. The cap assembly according to claim 1 which includes an annular ring extending outwardly from said wall member, said annular ring having a flange depending downwardly therefrom.

6. The cap assembly according to claim 1 wherein said second aperture closing member comprises a first portion and a second portion, said second portion when said second aperture closing member is adjusted to said first position forming a seal across said second aperture.

7. The cap assembly according to claim 6 wherein said second aperture closing member is secured to said cap.

8. The cap assembly according to claim 6 wherein said second aperture closing member is pivotably secured to said cap.

9. The cap assembly according to claim 6 wherein said top wall has formed therein a first recessed portion.

10. The cap assembly according to claim 9 wherein said top wall has formed therein a second recessed portion.

11. The cap assembly according to claim 6 which includes an annular ring extending outwardly from said wall member, said annular ring having a flange depending downwardly therefrom.

12. The cap assembly according to claim 1 wherein said top wall has formed therein a first recessed portion comprising sidewalls, an end wall, a curved portion at the opposite end of said first recessed portion from said end wall, and an upper surface of said first recessed portion, said curved portion having formed therein said first aperture.

13. The cap assembly according to claim 1 wherein said first aperture closing member comprising a base portion and an elongated portion, said base portion comprising a curved bottom wall, and a first planar portion and a second planar portion angled with respect to each other.

14. A cap assembly for drinking of liquids comprising a top wall, said top wall having a first aperture and a second aperture formed therein, said top wall having downwardly depending therefrom a flange, a wall member extending upwardly from at least a portion of said top wall, said wall member having an upper edge, said top wall being inclined relative to said upper edge, an annular ring extending outwardly from said wall member, said annular ring having said flange depending downwardly therefrom, said first and second aperture closing members, said first and second aperture closing members pivotably secured to said cap, said first and second aperture closing members both independently, and selectively adjustable to a first and a second position, said first aperture closing member comprising a base portion, said base portion having a channel formed therethrough, said base portion when said first aperture closing member is adjusted to said first position forming a seal across said first aperture, said base portion when said first aperture closing member is adjusted to said second position having said channel cooperate with said first aperture to form a passage through said cap for the drinking of a liquid, said second aperture closing member comprising a first portion and a second portion, said second portion when said second aperture closing member is adjusted to said first position forming a seal across said second aperture, said second aperture also forming a passage through said cap for the drinking of a liquid.

15. The cap assembly according to claim 14 wherein said top wall has formed therein a first recessed portion comprising sidewalls, an end wall, a curved portion at the opposite end of said first recesses portion from said end wall, and an upper surface of said first recessed portion, said curved portion having formed therein said first aperture.

16. The cap assembly according to claim 15 wherein said top wall has formed therein a first recessed portion, said first recessed portion being inclined relative to said upper edge.

17. The cap assembly according to claim 16 wherein said top wall has formed therein a second recessed portion, said second recessed portion being inclined relative to said upper edge.

18. The cap assembly according to claim 15 wherein said base portion also comprises a first planar portion and a second planar portion, said first aperture closing member also comprising an elongated portion, said elongated portion having formed therethrough a channel which is contiguous to said base portion channel.

19. The cap assembly according to claim 14 wherein said first aperture closing member comprises a base portion and an elongated portion, said base portion comprising a curved bottom wall, and a first planar portion and a second planar portion angled with respect to each other.

20. A cap assembly for drinking of liquids comprising a top wall having a first aperture and a second aperture formed therein, a wall member extending upwardly from at least a portion of said top wall, said wall member having an upper edge, said top wall being inclined relative to said upper edge, and first and second aperture closing members, said first and second aperture closing members both independently and selectively adjustable to a first and a second position, said first aperture closing member having a channel formed therethrough, said first aperture closing member when adjusted to said first position forming a seal across said first aperture, said first aperture closing member when adjusted to said second position having said channel cooperate with said first aperture to form a passage through said cap for the drinking of a liquid, said second aperture also forming a passage through said cap for the drinking of a liquid.

21. The cap assembly according to claim 20 wherein said second aperture closing member adjusted to said first position forming a seal across said second aperture.

* * * * *